US010057706B2

(12) United States Patent
Nishidate

(10) Patent No.: US 10,057,706 B2
(45) Date of Patent: Aug. 21, 2018

(54) INFORMATION PROCESSING DEVICE, INFORMATION PROCESSING SYSTEM, CONTROL METHOD, AND PROGRAM

(71) Applicant: Sony Computer Entertainment Inc., Tokyo (JP)

(72) Inventor: Masaomi Nishidate, Tokyo (JP)

(73) Assignee: SONY INTERACTIVE ENTERTAINMENT INC., Tokyo (JP)

( * ) Notice: Subject to any disclaimer, the term of this patent is extended or adjusted under 35 U.S.C. 154(b) by 46 days.

(21) Appl. No.: 14/850,414

(22) Filed: Sep. 10, 2015

(65) Prior Publication Data

US 2016/0150314 A1 May 26, 2016

(30) Foreign Application Priority Data

Nov. 26, 2014 (JP) ..... 2014-239088

(51) Int. Cl.
*H04R 29/00* (2006.01)
*H04S 7/00* (2006.01)
*H04R 1/40* (2006.01)

(52) U.S. Cl.
CPC ..... *H04S 7/303* (2013.01); *H04R 1/403* (2013.01); *H04R 2201/025* (2013.01); *H04S 2400/13* (2013.01)

(58) Field of Classification Search
CPC ..... H04R 1/403; H04R 2201/025; H04S 2400/13; H04S 7/303
USPC ..... 381/58, 61, 63, 104, 160
See application file for complete search history.

(56) References Cited

U.S. PATENT DOCUMENTS 4,731,848 A * 3/1988 Kendall ..... G10H 1/0091 381/63
7,580,530 B2 * 8/2009 Konagai ..... H04R 3/12 381/61
2004/0196983 A1 * 10/2004 Kushida ..... G10K 15/12 381/63

(Continued)

FOREIGN PATENT DOCUMENTS

EP 1 667 488 A1 6/2006
JP 2005-101902 4/2005

(Continued)

OTHER PUBLICATIONS

International Preliminary Report on Patentability dated May 30, 2017 for the Corresponding PCT Application No. PCT/JP2015/082678.

(Continued)

*Primary Examiner* — Vivian Chin
*Assistant Examiner* — Friedrich W Fahnert
(74) *Attorney, Agent, or Firm* — Katten Muchin Rosenman LLP

(57) ABSTRACT

An information processing device includes: a reflecting surface determining section configured to determine a reflecting surface as an object for reflecting a sound; a reflecting surface information obtaining section configured to obtain reflecting surface information indicating a reflection characteristic of the determined reflecting surface; and an output control portion configured to output a directional sound according to the obtained reflecting surface information to the determined reflecting surface.

11 Claims, 11 Drawing Sheets

(56) References Cited

U.S. PATENT DOCUMENTS

| | | | | |
|---|---|---|---|---|
| 2006/0137439 | A1* | 6/2006 | Mallebay-Vacqueur | G01M 17/007 73/147 |
| 2009/0196440 | A1* | 8/2009 | Suzuki | H04R 5/04 381/160 |
| 2010/0150359 | A1* | 6/2010 | KnicKrehm | G01H 7/00 381/58 |
| 2012/0020189 | A1* | 1/2012 | Agevik | G01H 7/00 367/127 |
| 2013/0163780 | A1* | 6/2013 | Blair | H04R 3/12 381/77 |
| 2015/0063597 | A1* | 3/2015 | Daly | H04S 7/302 381/104 |
| 2015/0373477 | A1* | 12/2015 | Norris | H04M 1/72572 381/303 |

FOREIGN PATENT DOCUMENTS

| | | |
|---|---|---|
| JP | 2010-056710 | 3/2010 |
| JP | 2012-029096 A | 2/2012 |
| JP | 2012-049663 | 3/2012 |
| WO | 2011/145030 A1 | 11/2011 |

OTHER PUBLICATIONS

Extended European Search Report dated Jun. 1, 2018 for the Corresponding European Patent Application No. 15863624.1.

* cited by examiner

| AUDIO DATA | AUDIO OUTPUT CONTROL PARAMETER |
|---|---|
| AUDIO SIGNAL a | OUTPUT CONDITION a |
| AUDIO SIGNAL b | OUTPUT CONDITION b |

FIG. 6

| MATERIAL NAME | MATERIAL FEATURE INFORMATION | REFLECTANCE |
|---|---|---|
| MATERIAL 1 | FEATURE INFORMATION 1 | R1 |
| MATERIAL 2 | FEATURE INFORMATION 2 | R2 |

FIG. 7

| USER ID | USER FEATURE INFORMATION | POSITION INFORMATION |
|---|---|---|
| USER A | FEATURE INFORMATION a | POSITION Pa |
| USER B | FEATURE INFORMATION b | POSITION Pb |

FIG. 9

| DIVIDED REGION ID | SOUND GENERATING POSITION |
|---|---|
| DIVIDED REGION 1 | LOWER RIGHT FRONT |
| DIVIDED REGION 2 | LOWER LEFT FRONT |
| DIVIDED REGION 3 | UPPER LEFT FRONT |
| DIVIDED REGION 4 | UPPER RIGHT FRONT |
| DIVIDED REGION 5 | LOWER RIGHT REAR |
| DIVIDED REGION 6 | LOWER LEFT REAR |
| DIVIDED REGION 7 | UPPER LEFT REAR |
| DIVIDED REGION 8 | UPPER RIGHT REAR |

FIG. 10

| DIVIDED REGION ID | CANDIDATE REFLECTING SURFACE | POSITION INFORMATION | ARRIVAL DISTANCE | REFLECTANCE | ANGLE OF INCIDENCE |
|---|---|---|---|---|---|
| DIVIDED REGION 1 | REFLECTING SURFACE 1 | POSITION P1 | DISTANCE D1 | R1 | T1 |
| DIVIDED REGION 2 | REFLECTING SURFACE 2 | POSITION P2 | DISTANCE D2 | R2 | T2 |
| DIVIDED REGION 3 | REFLECTING SURFACE 3 | POSITION P3 | DISTANCE D3 | R3 | T3 |
| DIVIDED REGION 4 | REFLECTING SURFACE 4 | POSITION P4 | DISTANCE D4 | R4 | T4 |

INFORMATION PROCESSING DEVICE, INFORMATION PROCESSING SYSTEM, CONTROL METHOD, AND PROGRAM

BACKGROUND

The present technology relates to an information processing device, an information processing system, a control method, and a program.

There is a directional speaker that outputs a directional sound such that the sound can be heard in only a particular direction, or which makes a directional sound reflected by a reflecting surface and thereby makes a user feel as if the sound is emitted from the reflecting surface.

SUMMARY

When the directional sound is reflected by the reflecting surface, reflection characteristics differ according to the material and orientation of the reflecting surface. Therefore, even when the same sound is output, the characteristics of the sound such as a volume, a frequency, and the like may be changed depending on the reflecting surface. In the past, however, no consideration has been given to the reflection characteristics depending on the material and orientation of the reflecting surface.

The present technology has been made in view of the above problems. It is desirable to provide an information processing device that controls the output of a directional sound according to the reflection characteristics of a reflecting surface.

According to an embodiment of the present technology, there is provided an information processing device including: a reflecting surface determining section configured to determine a reflecting surface as an object reflecting a sound; a reflecting surface information obtaining section configured to obtain reflecting surface information indicating a reflection characteristic of the determined reflecting surface; and an output control portion configured to output a directional sound according to the obtained reflecting surface information to the determined reflecting surface.

In addition, in the above-described information processing device, the reflecting surface information obtaining section may obtain reflectance of the reflecting surface as the reflecting surface information.

In addition, in the above-described information processing device, the output control portion may determine an output volume of the directional sound according to the obtained reflectance.

In addition, in the above-described information processing device, the reflecting surface information obtaining section may obtain, as the reflecting surface information, an angle of incidence at which the directional sound is incident on the reflecting surface.

In addition, in the above-described information processing device, the output control portion may determine an output volume of the directional sound according to the obtained angle of incidence.

In addition, in the above-described information processing device, the reflecting surface information obtaining section may obtain, as the reflecting surface information, an arrival distance to be traveled by the directional sound before arriving at a user via the reflecting surface reflecting the directional sound.

In addition, in the above-described information processing device, the output control portion may determine an output volume of the directional sound according to the obtained arrival distance.

In addition, in the above-described information processing device, the reflecting surface information obtaining section may obtain the reflecting surface information of each of a plurality of candidate reflecting surfaces as candidates for the reflecting surface, and the information processing device may further include a reflecting surface selecting section configured to select a candidate reflecting surface having an excellent reflection characteristic indicated by the reflecting surface information of the candidate reflecting surface among the plurality of candidate reflecting surfaces.

In addition, in the above-described information processing device, the reflecting surface information obtaining section may obtain the reflecting surface information on a basis of feature information of an image of the reflecting surface photographed by a camera.

In addition, according to an embodiment of the present technology, there is provided an information processing system including: a directional speaker configured to make a nondirectional sound generated by making a directional sound reflected by a predetermined reflecting surface reach a user; a reflecting surface determining section configured to determine the reflecting surface as an object reflecting the directional sound; a reflecting surface information obtaining section configured to obtain reflecting surface information indicating a reflection characteristic of the determined reflecting surface; and an output control portion configured to output the directional sound according to the obtained reflecting surface information from the directional speaker to the determined reflecting surface.

In addition, according to an embodiment of the present technology, there is provided a control method including: determining a reflecting surface as an object reflecting a sound; obtaining reflecting surface information indicating a reflection characteristic of the determined reflecting surface; and outputting a directional sound according to the obtained reflecting surface information to the determined reflecting surface.

In addition, according to an embodiment of the present technology, there is provided a program for a computer. The program includes: by a reflecting surface determining section, determining a reflecting surface as an object reflecting a sound; by a reflecting surface information obtaining section, obtaining reflecting surface information indicating a reflection characteristic of the determined reflecting surface; and by an output control portion, outputting a directional sound according to the obtained reflecting surface information to the determined reflecting surface. This program may be stored on a computer readable information storage medium.

BRIEF DESCRIPTION OF THE DRAWINGS

FIG. 6 is a diagram showing an example of material feature information;

FIG. 7 is a diagram showing an example of user position information;

FIG. 9 is a diagram showing an example of divided region information;

FIG. 10 is a diagram showing an example of candidate reflecting surface information;

DETAILED DESCRIPTION OF THE PREFERRED EMBODIMENTS

First Embodiment

A first embodiment of the present technology will hereinafter be described in detail with reference to the drawings.

[1. Hardware Configuration]

Figure 1:
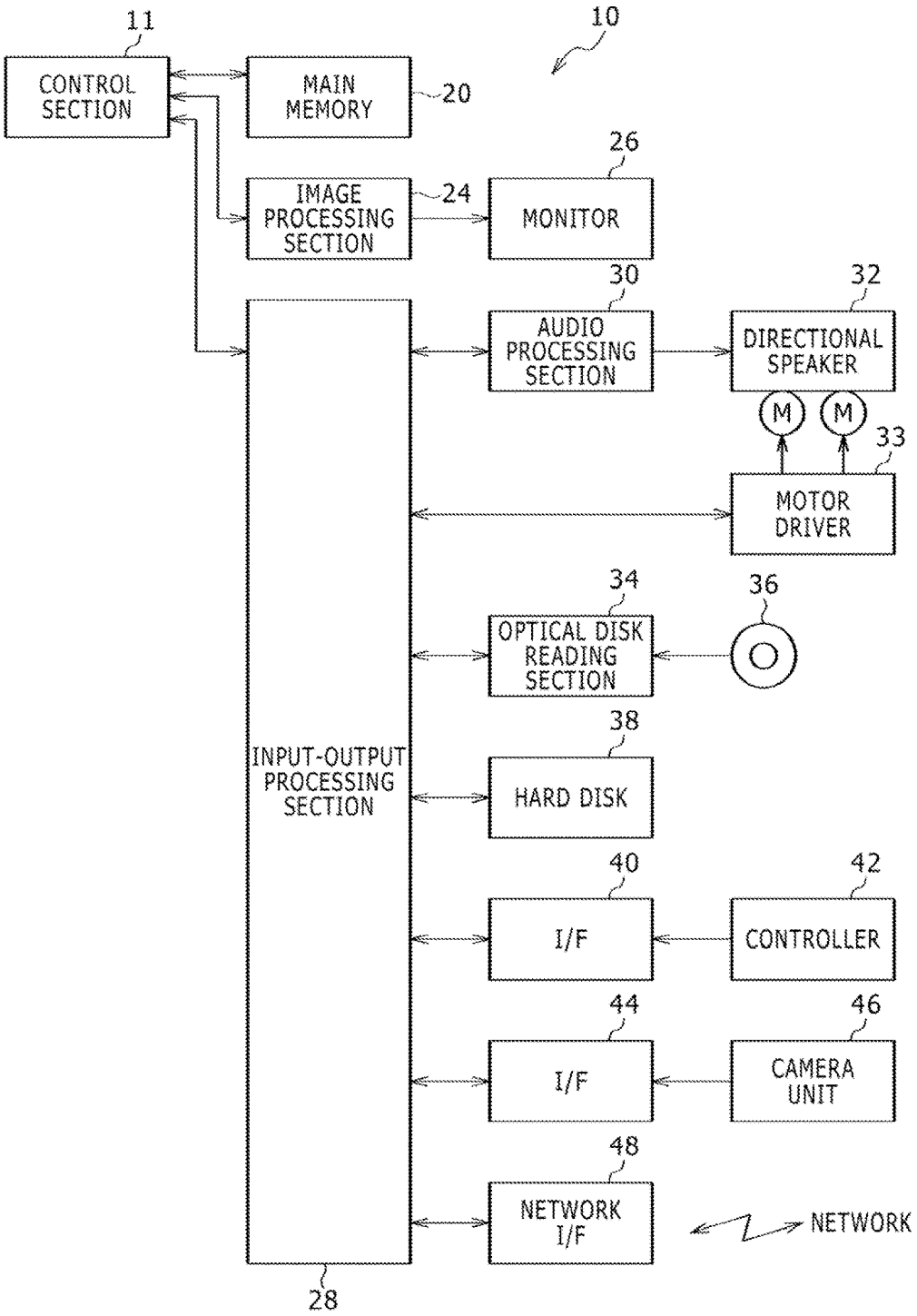
FIG. 1 is a diagram showing a hardware configuration of an entertainment system according to a first embodiment.

FIG. 1 is a diagram showing a hardware configuration of an entertainment system (sound output system) 10 according to an embodiment of the present technology. As shown in FIG. 1, the entertainment system 10 is a computer system including a control section 11, a main memory 20, an image processing section 24, a monitor 26, an input-output processing section 28, an audio processing section 30, a directional speaker 32, an optical disk reading section 34, an optical disk 36, a hard disk 38, an interface (I/F) 40, a controller 42, and a network I/F 44.

The control section 11 includes for example a central processing unit (CPU), a microprocessor unit (MPU), or a graphical processing unit (GPU). The control section 11 performs various kinds of processing according to a program stored in the main memory 20. A concrete example of the processing performed by the control section 11 in the present embodiment will be described later.

The main memory 20 includes a memory element such as a random access memory (RAM), a read only memory (ROM), and the like. A program and data read out from the optical disk 36 and the hard disk 38 and a program and data supplied from a network via a network I/F 48 are written to the main memory 20 as required. The main memory 20 also operates as a work memory for the control section 11.

The image processing section 24 includes a GPU and a frame buffer. The GPU renders various kinds of screens in the frame buffer on the basis of image data supplied from the control section 11. A screen formed in the frame buffer is converted into a video signal and output to the monitor 26 in predetermined timing. Incidentally, a television receiver for home use, for example, is used as the monitor 26.

The input-output processing section 28 is connected with the audio processing section 30, the optical disk reading section 34, the hard disk 38, the I/Fs 40 and 44, and the network I/F 48. The input-output processing section 28 controls data transfer from the control section 11 to the audio processing section 30, the optical disk reading section 34, the hard disk 38, the I/Fs 40 and 44, and the network I/F 48, and vice versa.

The audio processing section 30 includes a sound processing unit (SPU) and a sound buffer. The sound buffer stores various kinds of audio data such as game music, game sound effects, messages, and the like read out from the optical disk 36 and the hard disk 38. The SPU reproduces these various kinds of audio data, and outputs the various kinds of audio data from the directional speaker 32. Incidentally, in place of the audio processing section 30 (SPU), the control section 11 may reproduce the various kinds of audio data, and output the various kinds of audio data from the directional speaker 32. That is, the reproduction of the various kinds of audio data and the output of the various kinds of audio data from the directional speaker 32 may be realized by software processing performed by the control section 11.

Figure 2:
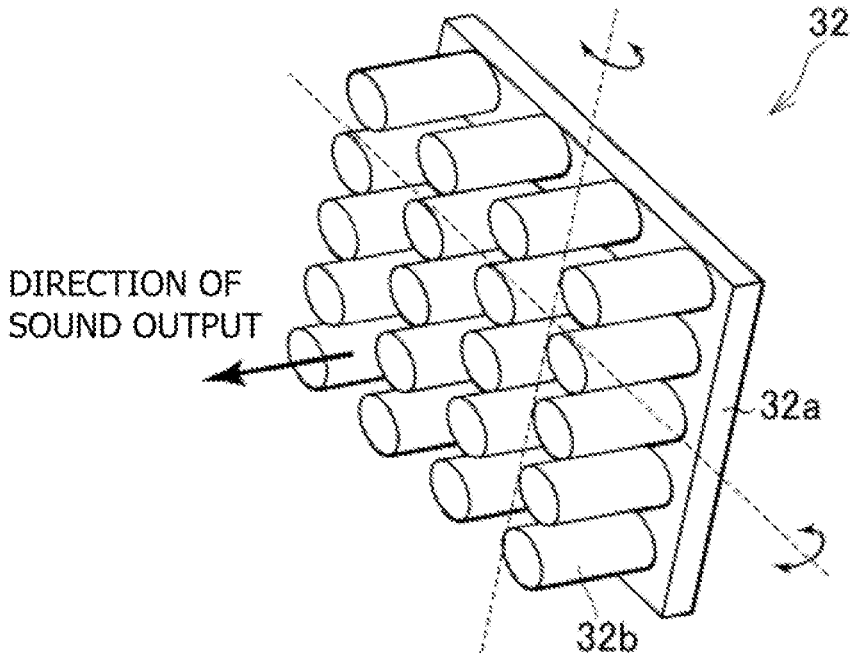
FIG. 2 is a diagram schematically showing an example of structure of a directional speaker.

The directional speaker 32 is for example a parametric speaker. The directional speaker 32 outputs directional sound. The directional speaker 32 is connected with an actuator for actuating the directional speaker 32. The actuator is connected with a motor driver 33. The motor driver 33 performs driving control of the actuator. FIG. 2 is a diagram schematically showing an example of the structure of the directional speaker 32. As shown in FIG. 2, the directional speaker 32 is formed by arranging a plurality of ultrasonic wave sounding bodies 32*b* on a board 32*a*. Ultrasonic waves output from the respective ultrasonic wave sounding bodies 32*a* are superimposed on each other in the air, and are thereby converted from ultrasonic waves to an audible sound. At this time, the audible sound is generated only at a central portion where the ultrasonic waves are superimposed on each other, and therefore a directional sound heard only in the traveling direction of the ultrasonic waves is produced. In addition, such a directional sound is diffusedly reflected by a reflecting surface, and is thereby converted into a nondirectional sound, so that a user can be made to feel as if a sound is produced from the reflecting surface. In the present embodiment, the motor driver 33 drives the actuator to rotate the directional speaker 32 about an x-axis and a y-axis. Thus, the direction of the directional sound output from the directional speaker 32 can be adjusted arbitrarily, and the directional sound can be reflected at an arbitrary position to make the user feel as if a sound is produced from the position.

The optical disk reading section 34 reads a program or data stored on the optical disk 36 according to an instruction from the control section 11. The optical disk 36 is for example an ordinary optical disk such as a DVD-ROM or the like. The hard disk 38 is an ordinary hard disk device. Various kinds of programs and data are stored on the optical disk 36 and the hard disk 38 in a computer readable manner. Incidentally, the entertainment system 10 may be configured to be able to read a program or data stored on another information storage medium than the optical disk 36 or the hard disk 38.

The optical disk 36 is for example an ordinary optical disk (computer readable information storage medium) such as a DVD-ROM or the like. The hard disk 38 is an ordinary hard disk device. Various kinds of programs and data are stored on the optical disk 36 and the hard disk 38 in a computer readable manner.

The I/Fs 40 and 44 are I/Fs for connecting various kinds of peripheral devices such as the controller 42, a camera unit 46, and the like. Universal serial bus (USB) I/Fs, for example, are used as such I/Fs. In addition, wireless communication I/Fs such as Bluetooth (registered trademark) I/Fs, for example, may be used.

The controller 42 is general-purpose operating input unit. The controller 42 is used for the user to input various kinds of operations (for example game operations). The input-output processing section 28 scans the state of each part of the controller 42 at intervals of a predetermined time (for example 1/60 second), and supplies an operation signal indicating a result of the scanning to the control section 11. The control section 11 determines details of the operation performed by the user on the basis of the operation signal. Incidentally, the entertainment system 10 is configured to be connectable with a plurality of controllers 42. The control section 11 performs various kinds of processing on the basis of operation signals input from the respective controllers 42.

The camera unit 46 includes a publicly known digital camera, for example. The camera unit 46 inputs a black-and-white, gray-scale, or color photographed image at intervals of a predetermined time (for example 1/60 second). The camera unit 46 in the present embodiment inputs the photographed image as image data in a joint photographic experts group (JPEG) format. In addition, the camera unit 46 is connected to the I/F 44 via a cable.

The network I/F 48 is connected to the input-output processing section 28 and a communication network. The network I/F 48 relays data communication of the entertainment system 10 with another entertainment system 10 via the communication network.

[2. Schematic General View]

Figure 3:
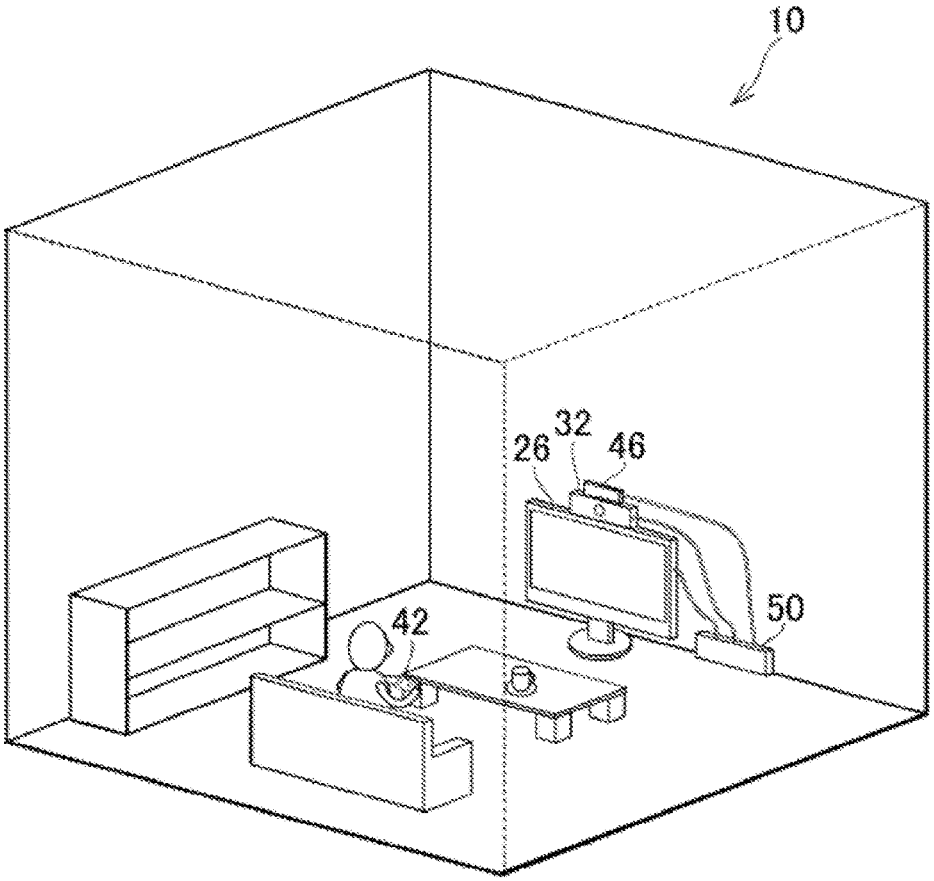
FIG. 3 is a schematic general view showing a usage scene of the entertainment system according to the first embodiment.

FIG. 3 is a schematic general view showing a usage scene of the entertainment system 10 according to the present embodiment. As shown in FIG. 3, the entertainment system 10 is used by the user in an individual room such that the room is surrounded by walls on four sides and various pieces of furniture are arranged in the room, for example. In this case, the directional speaker 32 is installed on the monitor 26 so as to be able to output a directional sound to an arbitrary position within the room. The camera unit 46 is also installed on the monitor 26 so as to be able to photograph the entire room. Then, the monitor 26, the directional speaker 32, and the camera unit 46 are connected to an information processing device 50, which is a game machine for home use or the like. When the user plays a game by operating the controller 42 using the entertainment system 10 in such a room, the entertainment system 10 first reads out a game program, audio data such as game sound effects and the like, and control parameter data for outputting each piece of audio data from the optical disk 36 or the hard disk 38 provided to the information processing device 50, and executes the game. Then, the entertainment system 10 controls the directional speaker 32 so as to produce a sound effect from a predetermined position according to a game image displayed on the monitor 26 and the conditions of progress of the game. The entertainment system 10 thereby provides a realistic game environment to the user. Specifically, for example, when an explosion occurs in the rear of a user character in the game, the sound of the explosion can be produced so as to be heard from the rear of the real user by making a wall in the rear of the user reflect a directional sound. In addition, when the heart rate of the user character in the game is increased, a heartbeat sound can be produced so as to be heard from the real user himself/herself by making the body of the user reflect a directional sound. When such production is made, reflection characteristics differ depending on the material and orientation of the reflecting surface (a wall, a desk, the body of the user, or the like) that reflects the directional sound. Therefore, sound having intended features (volume, the pitch of the sound, and the like) is not necessarily heard by the user. Accordingly, the present technology is configured to be able to control the output of the directional speaker 32 according to the material and orientation of the reflecting surface that reflects the directional sound. Incidentally, in the present embodiment, description will be made of a case where the user plays a game using the entertainment system 10. However, the present technology is also applicable to cases where the user views a moving image such as a movie or the like and cases where the user listens to only sound on the radio or the like.

The following description will be made of control of output of the directional speaker 32 by the entertainment system 10.

[3. Functional Block Diagram]

Figures 4, 5:
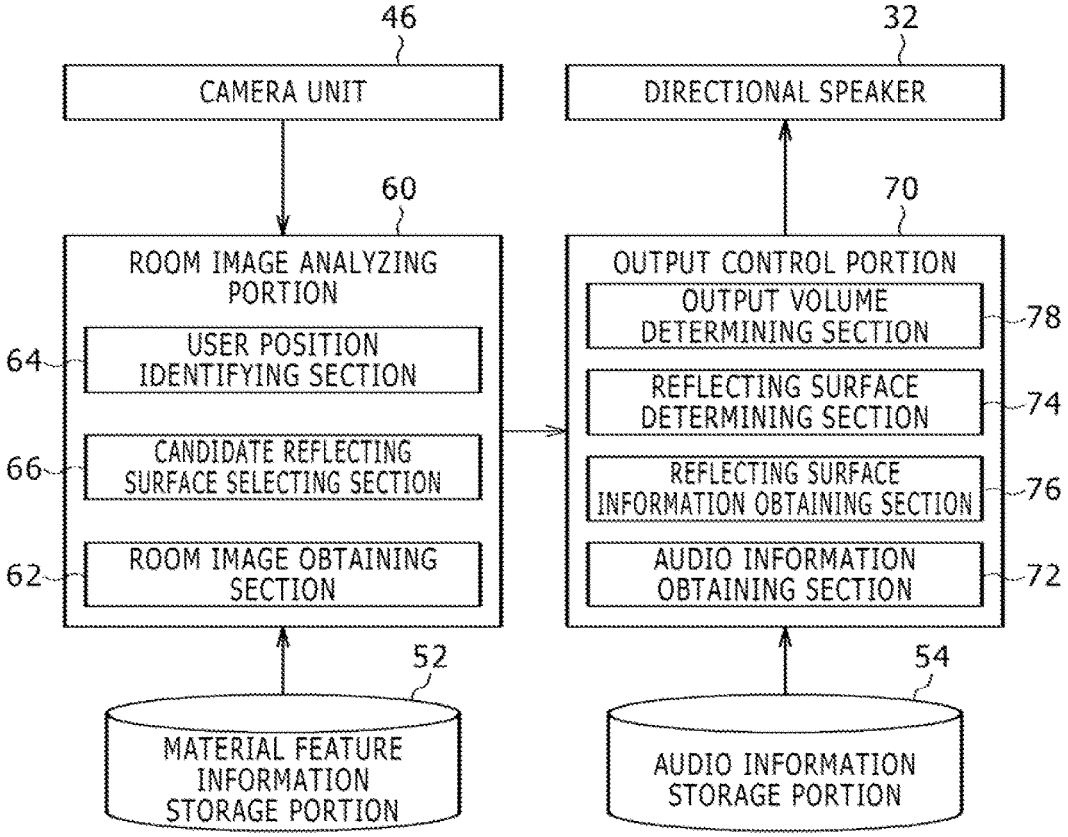
FIG. 4 is a functional block diagram showing an example of main functions performed by the entertainment system according to the first embodiment.
FIG. 5 is a diagram showing an example of audio information.

FIG. 4 is a functional block diagram showing an example of main functions performed by the entertainment system 10 according to the first embodiment. As shown in FIG. 4, the entertainment system 10 in the first embodiment functionally includes for example an audio information storage portion 54, a material feature information storage portion 52, a room image analyzing portion 60, and an output control portion 70. Of these functions, the room image analyzing portion 60 and the output control portion 70 are implemented by the control section 11 by performing a program read out from the optical disk 36 or the hard disk 38 or a program supplied from the network via the network I/F 48, for example. The audio information storage portion 54 and the material feature information storage portion 52 are implemented by the optical disk 36 or the hard disk 38, for example.

First, audio information in which audio data such as a game sound effect or the like and control parameter data (referred to as audio output control parameter data) for outputting each piece of audio data are associated with each other is stored in the audio information storage portion 54 in advance. Suppose in this case that the audio data is waveform data representing the waveform of an audio signal generated assuming that the audio data is to be output from the directional speaker 32. Suppose that the audio output control parameter data is a control parameter generated assuming that the audio data is to be output from the directional speaker 32. FIG. 5 is a diagram showing an example of the audio information. As shown in FIG. 5, the audio information is managed such that an audio signal and an output condition are associated with each other for each piece of audio data. An audio signal has a volume and a frequency (pitch of the sound) thereof defined by the waveform data of the audio signal. Suppose that each audio signal in the present embodiment has a volume and a frequency defined assuming that the audio signal is to be reflected by a reflecting surface having reflection characteristics serving as a reference. Specifically, set as a reflecting surface having reflection characteristics serving as a reference is a reflecting surface having the conditions of a reference arrival distance Dm (for example 4 m) as an arrival distance to be traveled by a sound until arriving at the user after being output from the directional speaker and reflected by the reflecting surface, a reference material M (for example wood) as the material of the reflecting surface, and a reference angle of incidence a degrees (for example 45 degrees) as an angle of incidence. Then, suppose that the volume and frequency of each audio signal are defined such that the sound arriving at the user after being reflected by the reflecting surface having the reflection characteristics serving as a reference as described above has intended features. The output condition is information indicating timing of outputting the audio data and a sound generating position at which to generate the sound. The output condition in the first embodiment is particularly information indicating a sound generating position with the user character in the game as a reference. The output condition is for example information indicating a direction or a position with the user character as a reference, such as a right side or a front as viewed from the user character. The direction of the directional sound output from the directional speaker 32 is determined on the basis of the output condition. Incidentally, suppose that no output condition is associated with audio data for which an output position is not defined in advance, and that the output condition is given according to game conditions or user operation.

In addition, the material feature information storage portion 52 stores material feature information in advance, the material feature information indicating relation between the material of a typical surface, the feature information of the surface, and reflectance of sound. FIG. 6 is a diagram showing an example of the material feature information. As shown in FIG. 6, the material feature information is managed such that a material name such as wood, metal, glass, or the like, material feature information as feature information obtained from an image when a material is photographed by the camera, and the reflectance of sound are associated with each other for each material. Suppose in this case that the feature information obtained from the image is for example the distribution of color components included in the image (for example color components in a color space such as RGB, variable bit rate (VBr), or the like), the distribution of saturation, and the distribution of lightness, and may be one or an arbitrary combination of two or more of these distributions.

[4. Room Image Analysis Processing]

The room image analyzing portion 60 analyzes the image of a room photographed by the camera unit 46. The room image analyzing portion 60 is mainly implemented by the control section 11. The room image analyzing portion 60 includes a room image obtaining section 62, a user position identifying section 64, and a candidate reflecting surface selecting section 66.

The room image obtaining section 62 obtains the image of the room photographed by the camera unit 46 in response to a room image obtaining request. The room image obtaining request is for example transmitted at the time of a start of a game or in predetermined timing according to the conditions of the game. In addition, the camera unit 46 may store, in the main memory 20, the image of the room which image is generated at intervals of a predetermined time (for example 1/60 second), and the image of the room which image is stored in the main memory 20 may be obtained in response to the room image obtaining request.

The user position identifying section 64 identifies the position of the user present in the room by analyzing the image of the room which image is obtained by the room image obtaining section 62 (which image will hereinafter be referred to as an obtained room image). The user position identifying section 64 detects a face image of the user present in the room from the obtained room image by using a publicly known face recognition technology. The user position identifying section 64 may for example detect parts of the face such as eyes, a nose, a mouth, and the like, and detect the face on the basis of the positions of these parts. The user position identifying section 64 may also detect the face using skin color information. The user position identifying section 64 may also detect the face using another detecting method. The user position identifying section 64 identifies the position of the thus detected face image as the position of the user. In addition, when there are a plurality of users in the room, the plurality of users can be distinguished from each other on the basis of differences in feature information obtained from the detected face images of the users. Then, the user position identifying section 64 stores, in a user position information storage section, user position information obtained by associating user feature information, which is feature information obtained from the face image of the user, and position information indicating the identified position of the user with each other. The position information indicating the position may be information indicating a distance from the imaging device (for example a distance from the imaging device to the face image of the user), or may be a coordinate value in a three-dimension space. FIG. 7 is a diagram showing an example of the user position information. As shown in FIG. 7, the user position information is managed such that a user identification (ID) given to each identified user, the user feature information obtained from the face image of the identified user, and the position information indicating the position of the user are associated with each other.

The user position identifying section 64 may also detect the controller 42 held by the user, and identify the position of the detected controller 42 as the position of the user. When identifying the position of the user by detecting the controller 42, the user position identifying section 64 detects light emitted from a light emitting portion of the controller 42 from the obtained room image, and identifies the position of the detected light as the position of the user. In addition, when there are a plurality of users in the room, the plurality of users may be distinguished from each other on the basis of differences between the colors of light emitted from light emitting portions of the controllers 42.

The candidate reflecting surface selecting section 66 selects a candidate for a reflecting surface for reflecting a directional sound output from the directional speaker 32 (which candidate will hereinafter be referred to as a candidate reflecting surface) on the basis of the obtained room image and the user position information stored in the user position information storage section. In this case, it suffices for the reflecting surface for reflecting the directional sound to have a size 6 cm to 9 cm square, and the reflecting surface for reflecting the directional sound may be for example a part of a surface of a wall, a desk, a chair, a bookshelf, a body of the user, or the like.

Figure 8:
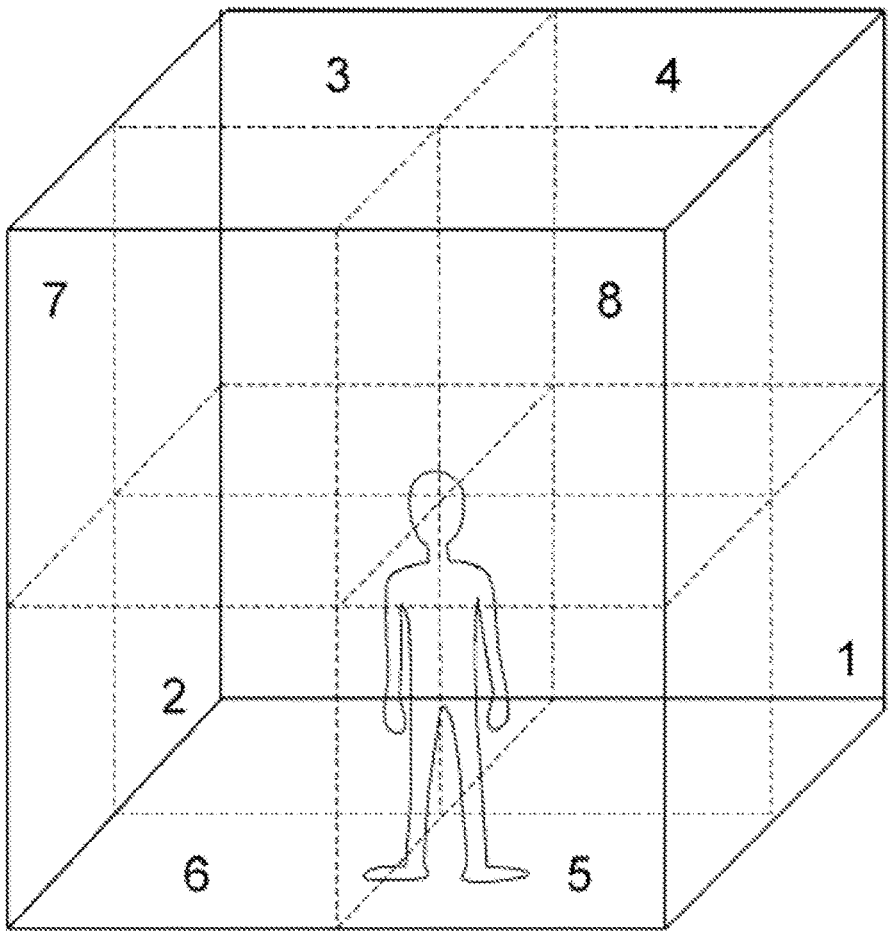
FIG. 8 is a diagram showing an example of divided regions.

First, the candidate reflecting surface selecting section 66 divides a room space into a plurality of divided regions according to sound generating positions at which to generate sound. The sound generating positions correspond to the output conditions included in the audio information stored in the audio information storage portion 54, and are defined with the user character in the game as a reference. The candidate reflecting surface selecting section 66 divides the room space into a plurality of divided regions corresponding to the sound generating positions with the position of the user as a reference, the position of the user being indicated by the user position information stored in the user position information storage section. FIG. 8 is a diagram showing an example of the divided regions. When eight kinds of sound generating positions are prepared with the user character in the game as a reference, the eight kinds of sound generating positions being a lower right front, a lower left front, an upper left front, an upper right front, a lower right rear, a lower left rear, an upper left rear, and an upper right rear, the room space is divided into eight divided regions (divided region IDs: 1 to 8) with the position of the real user as a reference, as shown in FIG. 8. The eight divided regions are a divided region 1 located in lower right front of the user, a divided region 2 located in lower left front of the user, a divided region 3 located in upper left front of the user, a divided region 4 located in upper right front of the user, a divided region 5 located in the lower right rear of the user, a divided region 6 located in the lower left rear of the user, a divided region 7 located in the upper left rear of the user, and a divided region 8 located in the upper right rear of the user. In addition, suppose that a divided region information storage section stores divided region information obtained by associating the divided regions formed by thus dividing the room space with the sound generating positions. FIG. 9 is a diagram showing an example of the divided region information. As shown in FIG. 9, the divided region information is managed such that the divided region IDs and the sound generating positions are associated with each other. Incidentally, the divided regions shown in FIG. 8 are a mere example. It suffices to divide the room space so as to form divided regions corresponding to sound generating positions defined according to a kind of game, for example.

Then, the candidate reflecting surface selecting section 66 selects, for each divided region, an optimum surface for reflecting sound as a candidate reflecting surface from surfaces present within the divided region. Suppose in this case that the optimum surface for reflecting sound is a surface having an excellent reflection characteristic, and is a surface formed of a material or a color of high reflectance, for example.

The processing of selecting a candidate reflecting surface will be described. First, the candidate reflecting surface selecting section 66 extracts surfaces that may be a candidate reflecting surface within a divided region from the obtained room image, and obtains the feature information of the extracted surfaces (referred to as extracted reflecting surfaces). The plurality of extracted reflecting surfaces within the divided region may be a candidate reflecting surface, and are candidates for the candidate reflecting surface. Then, the candidate reflecting surface selecting section 66 selects an extracted reflecting surface having a best reflection characteristic as a candidate reflecting surface from among the plurality of extracted reflecting surfaces within the divided region.

Suppose in this case that when the candidate reflecting surface selecting section 66 selects an extracted reflecting surface having a best reflection characteristic as a candidate reflecting surface, the candidate reflecting surface selecting section 66 compares the reflectances of the extracted reflecting surfaces with each other. First, the candidate reflecting surface selecting section 66 refers to the material feature information stored in the material feature information storage portion 52, and estimates the materials/reflectances of the extracted reflecting surfaces from the feature information of the extracted reflecting surfaces. The candidate reflecting surface selecting section 66 estimates the materials/reflectances of the extracted reflecting surfaces from the feature information of the extracted reflecting surfaces using a publicly known pattern matching technology, for example. However, the candidate reflecting surface selecting section 66 may use another method. Specifically, the candidate reflecting surface selecting section 66 matches the feature information of an extracted reflecting surface with the material feature information stored in the material feature information storage portion 52, and estimates a material/reflectance corresponding to material feature information having a highest degree of matching to be the material/reflectance of the extracted reflecting surface. The candidate reflecting surface selecting section 66 thus estimates the materials/reflectances of the respective extracted reflecting surfaces from the feature information of the plurality of extracted reflecting surfaces, respectively. Then, the candidate reflecting surface selecting section 66 selects an extracted reflecting surface having a best reflectance as a candidate reflecting surface from among the plurality of extracted reflecting surfaces within the divided region. The candidate reflecting surface selecting section 66 performs such processing for each divided region, whereby candidate reflecting surfaces for the divided regions are selected.

Incidentally, a method of estimating the reflectance of an extracted reflecting surface is not limited to the above-described method. For example, the directional speaker 32 may actually output a sound to an extracted reflecting surface, and a microphone may collect the reflected sound reflected by the extracted reflecting surface, whereby the reflectance of the extracted reflecting surface may be measured. In addition, the reflectance of light may be measured by outputting light to an extracted reflecting surface, and detecting the reflected light reflected by the extracted reflecting surface. Then, the reflectance of light may be used as a replacement for the reflectance of sound to select a candidate reflecting surface, or the reflectance of sound may be estimated from the reflectance of light.

In addition, when the candidate reflecting surface selecting section 66 selects an extracted reflecting surface having a best reflection characteristic as a candidate reflecting surface, the candidate reflecting surface selecting section 66 may compare, with each other, angles of incidence at which a directional sound output from the directional speaker 32 is incident on the extracted reflecting surfaces. This utilizes a characteristic of reflection efficiency being improved as the angle of incidence is increased. In this case, the candidate reflecting surface selecting section 66 calculates an angle of incidence at which a straight line extending from the directional speaker 32 is incident on an extracted reflecting surface on the basis of the obtained room image. Then, the candidate reflecting surface selecting section 66 calculates an angle of incidence at which a straight line extending from the directional speaker 32 is incident on each of the plurality of extracted reflecting surfaces, and selects an extracted reflecting surface with a largest angle of incidence as a candidate reflecting surface.

In addition, when the candidate reflecting surface selecting section 66 selects an extracted reflecting surface having a best reflection characteristic as a candidate reflecting surface, the candidate reflecting surface selecting section 66 may compare arrival distances of sound with each other, the arrival distances of sound each being a sum total of a straight-line distance from the directional speaker 32 to an extracted reflecting surface and a straight-line distance from the extracted reflecting surface to the user. This is based on an idea that the shorter the distance traveled by audio data output from the directional speaker 32 before arriving at the user via a reflecting surface that reflects the audio data, the easier the hearing of the sound by the user. In this case, the candidate reflecting surface selecting section 66 calculates the arrival distance on the basis of the obtained room image. Then, the candidate reflecting surface selecting section 66 calculates the arrival distances via the plurality of extracted reflecting surfaces, respectively, and selects an extracted reflecting surface corresponding to a shortest arrival distance as a candidate reflecting surface.

A candidate reflecting surface information storage section stores candidate reflecting surface information indicating the candidate reflecting surface selected by the candidate reflecting surface selecting section 66 as described above. FIG. 10 is a diagram showing an example of the candidate reflecting surface information. As shown in FIG. 10, the candidate reflecting surface information is managed such that for each divided region, a divided region ID indicating the divided region, position information indicating the position of a candidate reflecting surface, an arrival distance indicating a distance to be traveled by a sound output from the directional speaker 32 before arriving at the user via the reflecting surface that reflects the sound, the reflectance of the candidate reflecting surface, and the angle of incidence of the directional sound on the candidate reflecting surface are associated with each other.

Incidentally, when the candidate reflecting surface selecting section 66 selects an extracted reflecting surface having a best reflection characteristic as a candidate reflecting surface, the candidate reflecting surface selecting section 66 may arbitrarily combine two or more of the reflectance of the extracted reflecting surface, the angle of incidence of the extracted reflecting surface, and the arrival distance described above to select the surface having excellent reflection characteristics.

The room image analysis processing as described above can select an optimum reflecting surface for reflecting a directional sound irrespective of the shape of the room or the position of the user.

Figure 11:
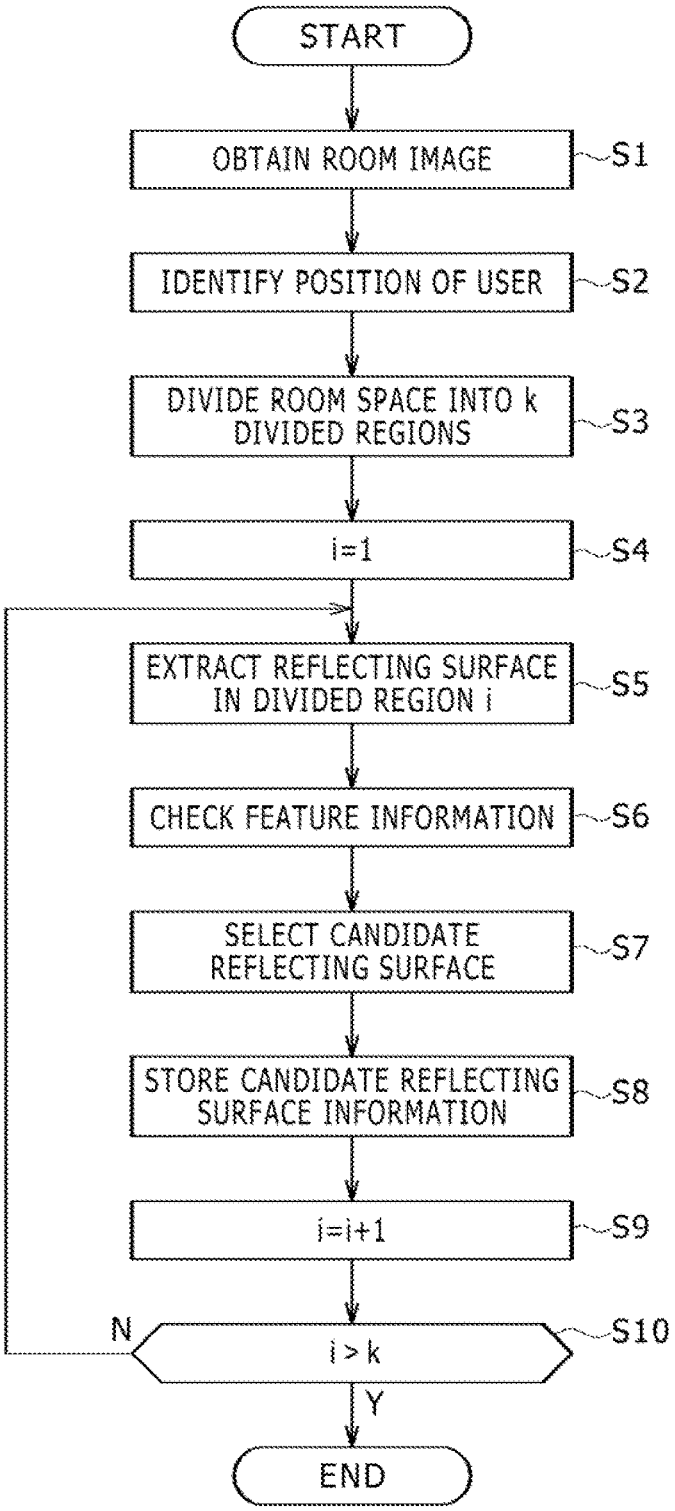
FIG. 11 is a flowchart of an example of a flow of room image analysis processing performed by the entertainment system according to the first embodiment.

An example of a flow of the room image analysis processing performed by the entertainment system 10 according to the first embodiment will be described in the following with reference to a flowchart of FIG. 11.

First, the room image obtaining section 62 obtains a room image photographed by the camera unit 46 in response to a room image obtaining request (S1).

Then, the user position identifying section 64 identifies the position of the user from the obtained room image obtained by the room image obtaining section 62 (S2).

Then, the candidate reflecting surface selecting section 66 divides the room space into a plurality of divided regions on the basis of the obtained room image (S3). Suppose in this case that the room space is divided into k divided regions, and that numbers 1 to k are given as divided region IDs to the respective divided regions. Then, the candidate reflecting surface selecting section 66 selects a candidate reflecting surface for each of the divided regions 1 to k.

The candidate reflecting surface selecting section 66 initializes a variable i to i=1 (S4). The variable i indicates a divided region ID, and is a counter variable assuming an integer value of 1 to k.

The candidate reflecting surface selecting section 66 extracts reflecting surfaces that may be a candidate reflecting surface from the divided region 1 on the basis of the obtained room image, and obtains the feature information of the extracted reflecting surfaces (S5).

The candidate reflecting surface selecting section 66 checks the feature information of the extracted reflecting surfaces obtained in the processing of S5 against the material feature information stored in the material feature information storage portion 52 (S6) to estimate the reflectances of the extracted reflecting surfaces. Then, the candidate reflecting surface selecting section 66 selects an extracted reflecting surface having a best reflectance as a candidate reflecting surface in the divided region 1 among the plurality of extracted reflecting surfaces (S7).

Then, the reflection characteristics of the candidate reflecting surface selected by the candidate reflecting surface selecting section 66 are stored as candidate reflecting surface information in the candidate reflecting surface information storage section (S8). In this case, the reflection characteristics are the reflectance of the candidate reflecting surface, the angle of incidence at which a sound output from the directional speaker is incident on the candidate reflecting surface, the arrival distance to be traveled by the sound output from the directional speaker before arriving at the user via the candidate reflecting surface reflecting the sound, and the like. The reflectance included in the candidate reflecting surface information may be a reflectance estimated from the material feature information stored in the material feature information storage portion 52, or may be a reflectance measured by collecting a reflected sound when audio data is actually output from the directional speaker to the candidate reflecting surface. In addition, suppose that the angle of incidence and the arrival distance included in the candidate reflecting surface information are calculated on the basis of the obtained room image. These reflection characteristics are stored in association with the divided region ID indicating the divided region and the position information indicating the position of the candidate reflecting surface.

Then, one is added to the variable i (S9), and the candidate reflecting surface selecting section 66 repeatedly performs the processing from S5 on down until i>k. When the variable i becomes larger than k (S10), the room image analysis processing is ended, and the candidate reflecting surface information of k candidate reflecting surfaces corresponding respectively to the divided regions 1 to k as shown in FIG. 10 is stored in the candidate reflecting surface information storage section.

The room image analysis processing as described above may be performed in timing of a start of the game, or may be performed periodically during the execution of the game. In the case where the room image analysis processing is periodically performed during the execution of the game, even when the user moves within the room during the game, appropriate sound output can be performed according to the movement of the user.

[5. Output Control Processing]

The output control portion 70 controls the orientation of the directional speaker 32 by controlling the motor driver 33, and outputs predetermined audio data from the directional speaker 32. The output control portion 70 is implemented mainly by the control section 11 and the audio processing section 30. The output control portion 70 includes an audio information obtaining section 72, a reflecting surface determining section 74, a reflecting surface information obtaining section 76, and an output volume determining section 78.

The output control portion 70 controls audio output from the directional speaker 32 on the basis of information on a determined reflecting surface which information is obtained by the reflecting surface information obtaining section 76 and audio information obtained by the audio information obtaining section 72. Specifically, the output control portion 70 changes audio data included in the audio information on the basis of the information on the determined reflecting surface so that the audio data according to the information on the determined reflecting surface is output from the directional speaker 32. In this case, the output control portion 70 changes the audio data so as to compensate for a change in feature of sound which change occurs due to a difference between the reflection characteristics of the determined reflecting surface and reflection characteristics serving as a reference. The audio data included in the audio information is data generated on the assumption that the audio data is reflected by a reflecting surface having the reflection characteristics serving as the reference, and the audio data is able to provide the user with a sound having intended features (volume, frequency, and the like) by being reflected by a reflecting surface having the reflection characteristics serving as the reference. When the audio data thus generated is reflected by a reflecting surface having different reflection characteristics from the reference, a sound having different features from the intended features may reach the user, so that a feeling of strangeness may be caused to the user. For example, when a sound is reflected by a reflecting surface having a reflectance lower than the reflectance of the reflection characteristics serving as the reference, the user hears a sound having a volume lower than an intended volume. Accordingly, in order to make the user hear the sound having the intended volume even when the sound is reflected by a reflecting surface having a lower reflectance than the reflectance as the reference, the output control portion 70 increases the volume of the audio data included in the obtained audio information. The output volume of the audio data for compensating for the change in feature of the sound, or an output change amount, is determined by the output volume determining section 78. Suppose in this case that a relation between the difference between the reflection characteristics of the determined reflecting surface and the reflection characteristics serving as the reference and the amount of change in feature of the sound which change occurs due to the difference is defined in advance. In addition, suppose that a relation between the amount of change in feature of the sound and the output volume of the audio data for compensating for the amount of change or the output change amount is also defined in advance.

The audio information obtaining section 72 obtains audio data to be output from the directional speaker 32 from the audio information storage portion 54 according to game conditions.

The reflecting surface determining section 74 determines a reflecting surface as an object for reflecting the audio data to be output from the directional speaker 32 from among the plurality of candidate reflecting surfaces included in the candidate reflecting surface information on the basis of the audio data obtained by the audio information obtaining section 72 and the candidate reflecting surface information. First, the reflecting surface determining section 74 identifies a divided region ID corresponding to an output condition associated with the obtained audio data. Then, the reflecting surface determining section 74 determines a candidate reflecting surface corresponding to the divided region ID identified by referring to the candidate reflecting surface information as a reflecting surface for reflecting the audio data to be output from the directional speaker 32.

The reflecting surface information obtaining section 76 obtains, from the candidate reflecting surface information, information on the candidate reflecting surface (referred to as a determined reflecting surface) determined as the reflecting surface for reflecting the audio data to be output from the directional speaker 32 by the reflecting surface determining section 74. Specifically, the reflecting surface information obtaining section 76 obtains, from the candidate reflecting surface information, the position information of the determined reflecting surface and information on an arrival distance, a reflectance, and an angle of incidence as the reflection characteristics of the determined reflecting surface.

Then, the output volume determining section 78 determines the output volume of the audio data according to the reflection characteristics of the determined reflecting surface which reflection characteristics are obtained by the reflecting surface information obtaining section 76. First, the output volume determining section 78 determines the output volume of the audio data according to the arrival distance to be traveled by the audio data until arriving at the user after being output from the directional speaker 32 and then reflected by the determined reflecting surface. Specifically, the output volume determining section 78 compares the arrival distance via the determined reflecting surface with a reference arrival distance. When the arrival distance via the determined reflecting surface is larger than the reference arrival distance, the output volume determining section 78 increases the output volume, or when the arrival distance via the determined reflecting surface is smaller than the reference arrival distance, the output volume determining section 78 decreases the output volume. An amount of increase of the output and an amount of decrease of the output are determined according to the difference between the arrival distance via the determined reflecting surface and the reference arrival distance.

The output volume determining section 78 determines the output volume of the audio data according to the reflectance of the determined reflecting surface. Specifically, the output volume determining section 78 compares the reflectance of the determined reflecting surface with the reflectance of a reference material. When the reflectance of the determined reflecting surface is larger than the reflectance of the reference material, the output volume determining section 78 decreases the output volume, and when the reflectance of the determined reflecting surface is smaller than the reflectance of the reference material, the output volume determining section 78 increases the output volume. An amount of increase of the output and an amount of decrease of the output are determined according to the difference between the reflectance of the determined reflecting surface and the reflectance of the reference material.

The output volume determining section 78 determines the output volume of the audio data according to the angle of incidence of the audio data output from the directional speaker 32 on the determined reflecting surface. Specifically, the output volume determining section 78 compares the angle of incidence on the determined reflecting surface with a reference angle of incidence. When the angle of incidence on the determined reflecting surface is larger than the reference angle of incidence, the output volume determining section 78 decreases the output volume, and when the angle of incidence on the determined reflecting surface is smaller than the reference angle of incidence, the output volume determining section 78 increases the output volume. An amount of increase of the output and an amount of decrease of the output are determined according to a difference between the angle of incidence on the determined reflecting surface and the reference angle of incidence.

Incidentally, the output volume determining section 78 may determine the output volume using one of the pieces of information of the arrival distance, the reflectance, and the angle of incidence as the above-described reflection characteristics of the determined reflecting surface, or may determine the output volume using an arbitrary combination of two or more of the pieces of information.

The output control portion 70 thus adjusts the orientation of the directional speaker 32 by controlling the motor driver 33 so that the audio data is output from the directional speaker 32 to the determined reflecting surface on the basis of the position information of the determined reflecting surface. Then, the output control portion 70 makes the audio data output from the directional speaker 32, the audio data having the output volume determined by the output volume determining section 78.

Incidentally, the output volume determining section 78 may determine the frequency of the audio data according to the arrival distance via the determined reflecting surface, the reflectance of the determined reflecting surface, and the angle of incidence on the determined reflecting surface.

The output control processing as described above can control audio output according to the reflection characteristics of the determined reflecting surface. The user can therefore listen to the sound having the intended features irrespective of the material of the determined reflecting surface, the position of the determined reflecting surface, the position of the user, or the like.

Figure 12:
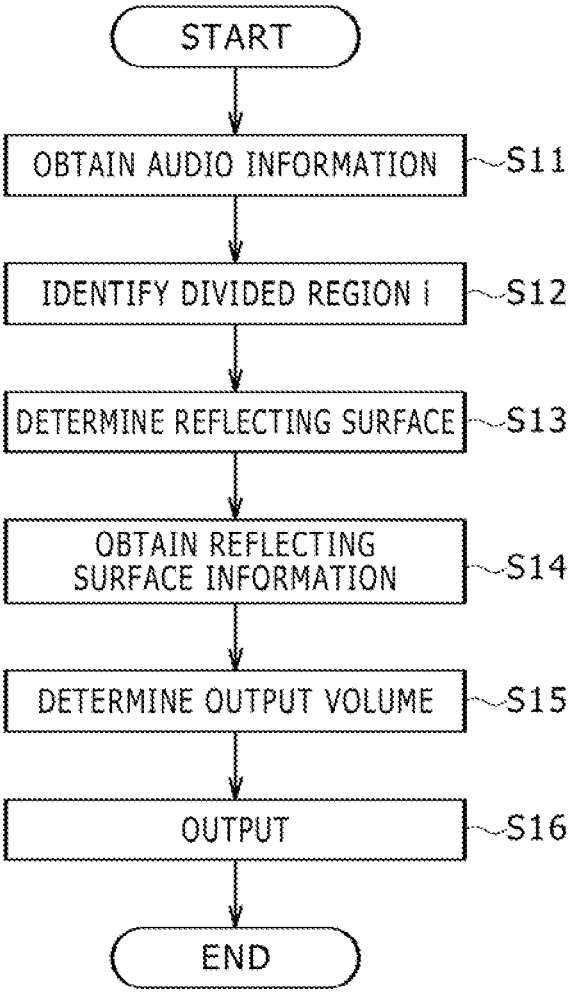
FIG. 12 is a flowchart of an example of a flow of sound output control processing performed by the entertainment system according to the first embodiment.

An example of a flow of the sound output control processing performed by the entertainment system 10 according to the first embodiment will be described in the following with reference to a flowchart of FIG. 12.

First, the audio information obtaining section 72 obtains the audio information of a sound to be output from the directional speaker 32 from the audio information stored in the audio information storage portion 54 (S11).

Then, the reflecting surface determining section 74 identifies a divided region on the basis of the audio information obtained by the audio information obtaining section 72 in step S11 and the divided region information stored in the divided region information storage section (S12). Here, the reflecting surface determining section 74 identifies the divided region corresponding to an output condition included in the audio information obtained by the audio information obtaining section 72 in step S11.

Next, the reflecting surface determining section 74 determines a candidate reflecting surface corresponding to the divided region identified in step S12 as a determined reflecting surface for reflecting the audio data to be output from the directional speaker 32, from the candidate reflecting surface information stored in the candidate reflecting surface information storage section (S13). Then, the reflecting surface information obtaining section 76 obtains the reflecting surface information of the determined reflecting surface from the candidate reflecting surface information storage section (S14). Specifically, the reflecting surface information obtaining section 76 obtains position information indicating the position of the determined reflecting surface and the reflection characteristics (arrival distance, reflectance, and angle of incidence) of the determined reflecting surface.

Then, the output volume determining section 78 determines the output volume of the audio data to be output to the determined reflecting surface determined by the reflecting surface determining section 74 in step S13 (S15). The output volume determining section 78 determines the output volume on the basis of each of the arrival distance, the reflectance, and the angle of incidence as the reflection characteristics of the determined reflecting surface which reflection characteristics are obtained by the reflecting surface information obtaining section 76. Then, the output control portion 70 adjusts the orientation of the directional speaker 32 by controlling the motor driver 33 so that the audio data is output to the position indicated by the position information of the determined reflecting surface, and makes the audio data output from the directional speaker 32, the audio data having the output volume determined by the output volume determining section 78 in step S15 (S16). The sound output control processing is then ended.

Figure 13:
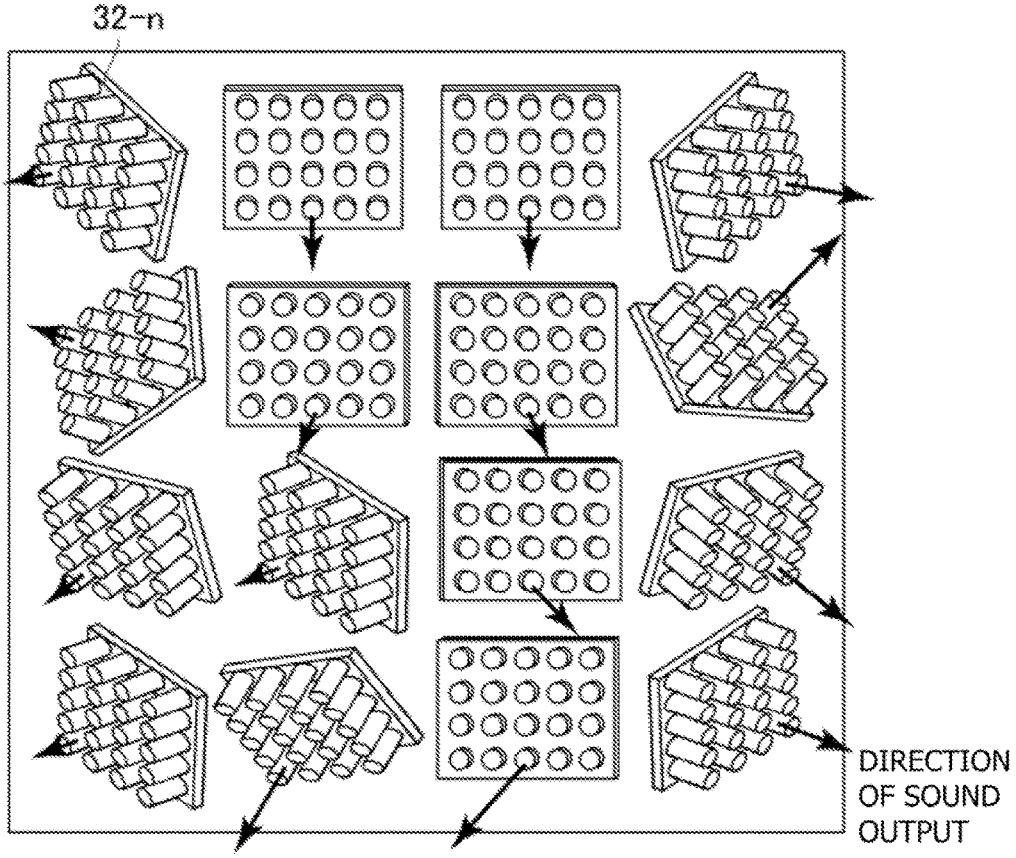
FIG. 13 is a diagram showing an example of a structure formed by arranging a plurality of directional speakers.

The entertainment system 10 may also include a plurality of directional speakers 32. FIG. 13 shows an example of a structure formed by arranging a plurality of directional speakers 32. As illustrated in FIG. 13, 16 directional speakers 32-*n* (n=1 to 16) that are each movable independently may be arranged. Suppose in this case that the directional speakers 32-*n* are adjusted in orientation so as to output audio data to respective different reflecting surfaces. When a game using the entertainment system 10 is started, or when the plurality of directional speakers 32-*n* are installed in a room, for example, reflecting surfaces to which to direct the respective directional speakers 32-*n* are determined on the basis of a room image obtained by the room image obtaining section 62. Suppose in this case that the once determined orientations of the directional speakers 32-*n* are basically fixed. When the orientations of the respective directional speakers 32-*n* are adjusted, the room space may be divided into a plurality of divided regions (for example dividing regions equal in number to the directional speakers 32) irrespective of the position of the user, and the directional speakers 32-*n* may be adjusted so as to be directed to reflecting surfaces within the respective different divided regions. Alternatively, reflecting surfaces having excellent reflection characteristics within the room which reflecting surfaces are equal in number to the directional speakers 32 may be selected, and the directional speakers 32-*n* may be adjusted so as to be directed to the respective different reflecting surfaces. Suppose that after the orientations of all of the directional speakers 32 are adjusted, the directional speakers 32-*n* and the position information of the reflecting surfaces to which the directional speakers 32-*n* are directed are then stored in association with each other. Then, suppose that when sound output processing is performed in the entertainment system 10 including such a plurality of directional speakers 32, a directional speaker 32 to be made to output audio data is selected on the basis of an output condition (sound generating position in this case) included in the audio information obtained by the audio information obtaining section 72, the position information of the reflecting surfaces to which the respective directional speakers 32 are directed, and the position information of the user. Specifically, the regions in which the reflecting surfaces are located with the user as a reference are determined on the basis of the position information of the reflecting surfaces and the position information of the user. Therefore, even when the user moves within the room, a region can be determined with the position of the user as a reference. Then, suppose that when a region in a reflecting surface is located coincides with the sound generating position, the directional speaker 32 corresponding to the reflecting surface is selected. Incidentally, suppose that when there is no region coinciding with the sound generating position, a directional speaker 32 corresponding to a reflecting surface located in a region closest to the sound generating position is selected. When the orientations of the plurality of directional speakers 32-*n* are thus determined in advance, the present technology can be applied also to cases where the quick responsiveness of sound output is desired, for example cases where a sound is output to a position with the position of the user as a reference according to a user operation.

Second Embodiment

In the first embodiment, description has been made of a case where the output conditions associated with the audio data stored in the audio information storage portion 54 are mainly information indicating sound generating positions with the user character in the game as a reference. In the second embodiment, further description will be made of a case where output conditions are information indicating particular positions within a room, such as information indicating sound generating positions with the position of an object within the room as a reference, information indicating predetermined positions on the basis of the structure of the room, and the like. Specifically, information indicating a particular position within the room is information indicating a position distant from the user by a predetermined distance or a predetermined range, such as 50 cm to the left of the position of the user or the like, information indicating a direction or a position as viewed from the user, such as a right side or a front as viewed from the user or the like, or information indicating a predetermined position on the basis of the structure of the room such as the center of the room or the like. Incidentally, when information indicating a sound generating position with the user character as a reference is associated with an output condition, information indicating a particular position in the room may be identified from the information.

A functional block diagram indicating an example of main functions performed by an entertainment system 10 according to the second embodiment is similar to the functional block diagram according to the first embodiment shown in FIG. 4 except that the functional block diagram indicating the example of the main functions performed by the entertainment system 10 according to the second embodiment does not include the candidate reflecting surface selecting section 66. The following description will be made of only parts different from those of the first embodiment, and repeated description will be omitted.

Description in the following will be made of output control processing by the output control portion 70 according to the second embodiment.

The audio information obtaining section 72 obtains audio data to be output from the directional speaker 32 from the audio information storage portion 54 according to game conditions. Suppose in this case that the output condition of the audio data is associated with information indicating a particular position within the room such as a predetermined position with an object within the room as a reference. For example, suppose that the output condition is information indicating a particular position within the room such as 50 cm to the left of the position of the user, 30 cm in front of the display, the center of the room, or the like.

First, the reflecting surface determining section 74 determines a reflecting surface as an object for reflecting the audio data to be output from the directional speaker 32 on the basis of the audio data obtained by the audio information obtaining section 72. The reflecting surface determining section 74 identifies a position within the room which position corresponds to the position indicated by the output condition associated with the obtained audio data. For example, when a predetermined position with the position of the user as a reference (for example 50 cm to the left of the position of the user or the like) is associated with the output condition, the reflecting surface determining section 74 identifies the position of a reflecting surface from the position information of the user whose position is identified by the user position identifying section 64 and the information on the position indicated by the output condition. In addition, suppose that when a predetermined position with the position of an object other than the user as a reference (for example 30 cm in front of the display) is associated with the output condition, the position of the associated object is identified, and position information thereof is obtained.

The reflecting surface information obtaining section 76 obtains reflecting surface information on the reflecting surface determined by the reflecting surface determining section 74 (which reflecting surface will be referred to as a determined reflecting surface). Specifically, the reflecting surface information obtaining section 76 obtains position information indicating the position of the determined reflecting surface, the reflection characteristics of the determined reflecting surface, and the like. First, the reflecting surface information obtaining section 76 obtains, from a room image, the feature information of a determined reflecting surface image corresponding to the position of the determined reflecting surface, an arrival distance to be traveled by the audio data until arriving at the user after being output from the directional speaker 32 and then reflected by the determined reflecting surface, and an angle of incidence of the audio data to be output from the directional speaker 32 on the determined reflecting surface. In this case, the determined reflecting surface image may be an image of a region in a predetermined range with the position of the determined reflecting surface as a center. Then, the reflecting surface information obtaining section 76 identifies the material and reflectance of the determined reflecting surface by comparing the obtained feature information of the determined reflecting surface image with the material feature information stored in the material feature information storage portion 52. The reflecting surface information obtaining section 76 thus obtains information on the reflectance, the arrival distance, and the angle of incidence as the reflection characteristics of the determined reflecting surface.

The output volume determining section 78 determines the output volume of the audio data to be output to the determined reflecting surface. In this case, when the reflection characteristics of the reflecting surface determined by the reflecting surface determining section 74 are different from reflection characteristics serving as a reference, the output volume defined in the audio data stored in the audio information storage portion is changed so that the user can hear the audio data having an intended volume. The output volume determining section 78 determines the output volume of the audio data according to the reflectance, the arrival distance, and the angle of incidence as the reflection characteristics of the determined reflecting surface. The output volume determination processing by the output volume determining section 78 is as described in the first embodiment.

Thus, the output control portion 70 adjusts the orientation of the directional speaker 32 by controlling the motor driver 33 to output the audio data from the directional speaker 32 to the determined reflecting surface on the basis of the position information of the determined reflecting surface. Then, the output control portion 70 outputs the audio data having the output volume determined by the output volume determining section 78 from the directional speaker 32.

Thus, when a sound is to be heard from a particular position within the room, the intended sound can be made to be heard by the user according to the reflection characteristics of the reflecting surface at the particular position, and the intended sound can be generated from the arbitrary position without depending on conditions in the room such as the arrangement of furniture, the position of the user, the material of the reflecting surface, or the like.

Figure 14:
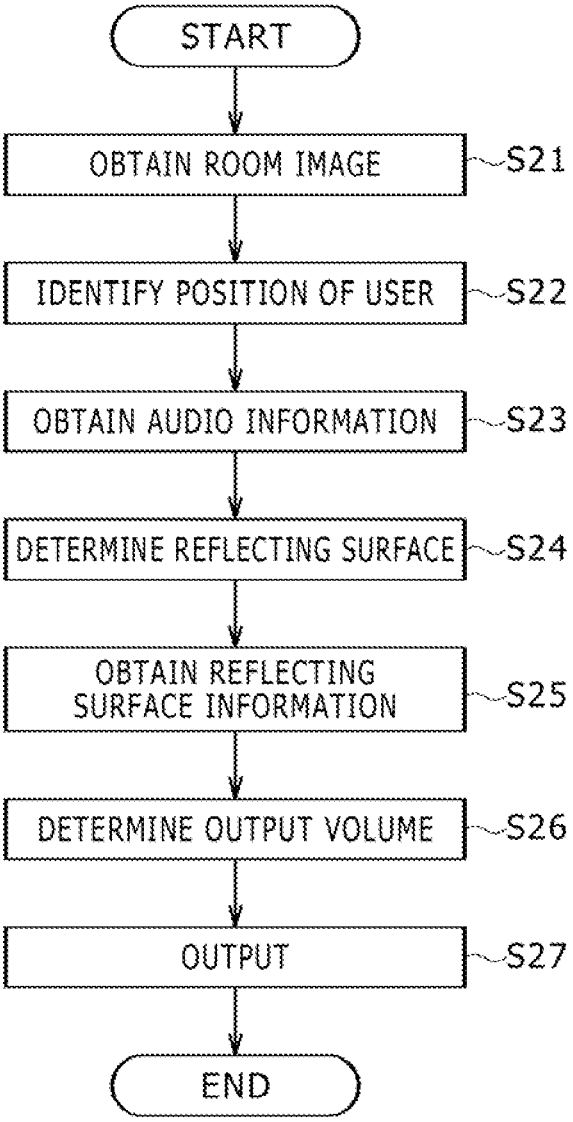
FIG. 14 is a flowchart of an example of a flow of sound output control processing performed by an entertainment system according to a second embodiment.

An example of a flow of sound output control processing performed by the entertainment system 10 according to the second embodiment will be described in the following with reference to a flowchart of FIG. 14.

First, the room image obtaining section 62 obtains a room image photographed by the camera unit 46 in response to a room image obtaining request (S21).

Then, the user position identifying section 64 identifies the position of the user from the obtained room image obtained by the room image obtaining section 62 (S22).

Next, the audio information obtaining section 72 obtains audio data to be output from the directional speaker 32 from the audio information stored in the audio information storage portion 54 (S23).

Then, the reflecting surface determining section 74 determines a reflecting surface on the basis of the audio data obtained by the audio information obtaining section 72 in step S23 (S24). Here, the reflecting surface determining section 74 identifies a reflecting surface corresponding to a reflecting position associated with the output condition of the audio data obtained by the audio information obtaining section 72.

The reflecting surface information obtaining section 76 obtains information on the determined reflecting surface determined by the reflecting surface determining section 74 in step S24 from the room image obtained by the room image obtaining section 62 (S25). Specifically, the reflecting surface information obtaining section 76 obtains position information indicating the position of the determined reflecting surface and the reflection characteristics (arrival distance, reflectance, and angle of incidence) of the determined reflecting surface.

Then, the output volume determining section 78 determines the output volume of the audio data to be output to the determined reflecting surface determined by the reflecting surface determining section 74 in step S24 (S26). The output volume determining section 78 determines the output volume on the basis of each of the arrival distance, the reflectance, and the angle of incidence as the reflection characteristics of the determined reflecting surface which reflection characteristics are obtained by the reflecting surface information obtaining section 76. Then, the output control portion 70 adjusts the orientation of the directional speaker 32 by controlling the motor driver 33 so as to output the audio data to the position indicated by the position information of the determined reflecting surface, and makes the audio data output from the directional speaker 32, the audio data having the output volume determined by the output volume determining section 78 in step S26 (S27). The sound output control processing is then ended.

Incidentally, when the reflection characteristics of the determined reflecting surface which reflection characteristics are obtained by the reflecting surface information obtaining section 76 are poor, the reflecting surface determining section 74 may change the reflecting surface for reflecting the audio data. That is, when the determined reflecting surface is a material that does not reflect easily, a search may be made for a reflecting surface in the vicinity, and a reflecting surface having better reflection characteristics may be set as the determined reflecting surface. In this case, the intended audio data may not reach the user when the reflecting surface to which the change is made is too far from the reflecting surface determined first. Thus, a search may be made within an allowable range (for example a radius of 30 cm) of the position of the reflecting surface determined first, and a reflecting surface having good reflection characteristics may be selected from within the allowable range. Incidentally, when there is no reflecting surface having good reflection characteristics within the allowable range, it suffices to perform the output volume determining processing by the output volume determining section 78 for the determined reflecting surface determined first. In this case, the candidate reflecting surface selection processing by the candidate reflecting surface selecting section 66 described in the first embodiment can be applied to the processing of selecting a reflecting surface having good reflection characteristics from within the allowable range.

In addition, the entertainment system 10 according to the second embodiment can be applied as an operating input system for the user to perform input operation. Specifically, suppose that one or more sound generating positions are set within the room, and that an object (a part of the body of the user or the like) is disposed at the corresponding sound generating position by a user operation. Then, a directional sound output from the directional speaker 32 to the sound generating position is reflected by the object disposed by the user, whereby a reflected sound is generated. Suppose that input information corresponding to the user operation is received on the basis of the thus generated reflected sound. In this case, it suffices to store the sound generating position, the audio data, and the input information in association with each other in advance, and be able to recognize the input information according to the sound generating position and the audio data of the reflected sound. For example, an operating input system is constructed which sets a sound generating position 30 cm to the right of the face of the user, and which can receive input information according to an user operation of raising a hand to the right side of the face or not raising the hand to the right side of the face. In this case, the input information (for example information indicating "yes") is associated with the sound generating position and the audio data of the reflected sound to be generated, and an instruction is output for allowing the user to select whether or not to raise the hand to the right side of the face (for example an instruction is output for instructing the user to raise the hand in a case of "yes" or not to raise the hand in a case of "no"). Therefore, the input information ("yes" or "no") can be received according to whether or not the reflected sound is generated. In addition, different pieces of audio data may be set at a plurality of sound generating positions by using a plurality of directional speakers 32, and may be associated with respective different pieces of input information. Then, when a reflected sound is generated by disposing an object such as a hand or the like at one of the plurality of sound generating positions by a user operation, the input information corresponding to the generated reflected sound may be received. For example, positions 30 cm to the left and right of the face of the user are associated with respective different pieces of audio data (for example "left: yes" and "right: no") and input information (for example information indicating "left: yes" and information indicating "right: no"), and an instruction is output for making the user to raise the hand to one of the left and right of the face according to a selection of "yes" or "no." In this case, when the user raises the hand to the right side of the face, a sound "no" is generated, and the input information "no" is received. When the user raises the hand to the left side of the face, a sound "yes" is generated, and the user input information "yes" is received. Therefore, when the plurality of sound generating positions are associated with the respective different pieces of audio data and the respective different pieces of input information, input information corresponding to a sound generating position and a generated reflected sound can be received. Thus, the entertainment system 10 according to the second embodiment can make a reflected sound generated at an arbitrary position, and is therefore also applicable as an operating input system using the directional speaker 32.

It is to be noted that the present technology is not limited to the above-described embodiments.

For example, there is a case where a particular object such as the body of the user, a glass on a table, a light in the room, a ceiling, or the like or a particular position is desired to be set as a sound generating position according to a kind of game. In such a case, information indicating an object may be associated as an output condition of audio information. Then, when the audio information obtaining section 72 obtains the audio information, an article within the room may be identified which article corresponds to the object indicated by the output condition on the basis of an obtained room image. Then, the reflection characteristics of the identified article may be obtained, and audio data may be output from the directional speaker 32 to the identified article according to the reflection characteristics.

In addition, in the above-described embodiments, the room image analyzing portion 60 analyzes the image of the room photographed by the camera unit 46. However, the present technology is not limited to this example. For example, a sound produced from the position of the user may be collected to identify the position of the user or estimate the structure of the room. Specifically, the entertainment system 10 may instruct the user to clap the hands or utter a voice, and thus make a sound generated from the position of the user. Then, the generated sound may be collected by using a microphone provided to the entertainment system 10 or the like to measure the position of the user, the size of the room, or the like.

In addition, the user may be allowed to select the reflecting surface as an object for reflecting a sound. For example, a room image obtained by the room image obtaining section 62 or the structure of the room which structure is estimated by collecting the sound produced from the position of the user may be displayed on the monitor 26 or another display unit, and the user may be allowed to select a reflecting surface while viewing the displayed room image or the like. In this case, a test may be conducted in which the user makes a sound actually generated at a position arbitrarily designated from the room image, and the user may actually listen to the generated sound and determine whether to set the position as the reflecting surface. Thus, an acoustic environment preferred by the user can be created. In addition, information on extracted reflecting surfaces extracted by the candidate reflecting surface selecting section 66 may be displayed on the monitor 26 or another display unit, and a position at which to conduct a test may be designated from among the extracted reflecting surfaces. In addition, the user may be allowed to select an object to be set as the reflecting surface. For example, objects within the room such as a ceiling, a floor, a wall, a desk, and the like may be extracted from the room image obtained by the room image obtaining section 62 and displayed on the monitor 26 or another display unit, and a position at which to conduct a test may be allowed to be designated from among the objects. Incidentally, after the user selects an object that the user desires to set as the reflecting surface (for example only the ceiling or the floor) from among the displayed objects, the reflecting surface determining section 74 may determine the reflecting surface such that sounds are reflected by only the object selected by the user.

In addition, in the foregoing embodiments, an example has been illustrated in which the monitor 26, the directional speaker 32, the controller 42, the camera unit 46, and the information processing device 50 are separate devices. However, the present technology is also applicable to a portable game machine as a device in which the monitor 26, the directional speaker 32, the controller 42, the camera unit 46, and the information processing device 50 are integral with each other, as well as a virtual reality game machine.

The present technology contains subject matter related to that disclosed in Japanese Priority Patent Application JP 2014-239088 filed in the Japan Patent Office on Nov. 26, 2014, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An information processing device comprising:

a reflecting surface determining section configured to determine a sound reflecting surface as an object reflecting a sound while the information processing device is concurrently outputting audio, wherein the sound reflecting surface determining section determines the sound reflecting surface by:

a) obtaining an image of a room captured by a camera;

b) identifying a position of a user in the room using the image;

c) dividing the image into a plurality of zones;

d) identifying the sound reflecting surface to be used in a zone from the plurality of zones; and e) periodically repeating steps a) to d) to determine if the sound reflecting surface has changed or if the position of the user blocks the sound reflecting surface;

a sound reflecting surface information obtaining section configured to obtain sound reflecting surface information indicating a sound reflection characteristic of the determined sound reflecting surface by determining a material of the sound reflecting surface from the image; and an output control portion configured to output a directional sound toward the identified sound reflecting surface according to the obtained sound reflecting surface information.

2. The information processing device according to claim 1, wherein the reflecting surface information obtaining section obtains a sound reflectance value of the sound reflecting surface as the sound reflecting surface information using the image.

3. The information processing device according to claim 2, wherein the output control portion determines an output volume of the directional sound according to the obtained sound reflectance value.

4. The information processing device according to claim 1, wherein the sound reflecting surface information obtaining section obtains, as the sound reflecting surface information, an angle of incidence at which the directional sound is incident on the sound reflecting surface by calculating the angle of incidence from the image.

5. The information processing device according to claim 4, wherein the output control portion determines an output volume of the directional sound according to the obtained angle of incidence.

6. The information processing device according to claim 1, wherein the sound reflecting surface information obtaining section obtains, as the sound reflecting surface information, an arrival distance to be traveled by the directional sound before arriving at a user via the sound reflecting surface reflecting the directional sound, wherein the arrival distance is periodically calculated and updated using the images from the camera.

7. The information processing device according to claim 6, wherein the output control portion determines an output volume of the directional sound according to the obtained arrival distance.

8. The information processing device according to claim 1, wherein the sound reflecting surface information obtaining section obtains the sound reflecting surface information of each of a plurality of candidate sound reflecting surfaces as candidates for the sound reflecting surface by analyzing the plurality of zones, and the information processing device further includes a sound reflecting surface selecting section configured to select a candidate sound reflecting surface having a greatest sound reflection characteristic indicated by the sound reflecting surface information of the candidate sound reflecting surface among the plurality of candidate sound reflecting surfaces.

9. An information processing system comprising:

a directional speaker configured to make a nondirectional sound generated by making a directional sound reflected by a predetermined sound reflecting surface reach a user;

a sound reflecting surface determining section configured to determine the sound reflecting surface as an object reflecting the directional sound by:

a) obtaining an image of a room captured by a camera;

b) identifying a position of a user in the room using the image;

c) dividing the image into a plurality of zones;

d) identifying the sound reflecting surface in a zone from the plurality of zones; and e) periodically repeating steps a) to d) to determine if the sound reflecting surface has changed or if the position of the user blocks the sound reflecting surface;

a sound reflecting surface information obtaining section configured to obtain sound reflecting surface information indicating a sound reflection characteristic of the determined sound reflecting surface by determining a material of the sound reflecting surface from the image; and an output control portion configured to output the directional sound from the directional speaker toward the identified sound reflecting surface according to the obtained sound reflecting surface information.

10. A control method for outputting directional audio comprising:

periodically obtaining an image of a room captured by a camera;

for each captured image a) identifying a position of a user in the room using the image;

b) dividing the image into a plurality of zones;

c) identifying a sound reflecting surface in each of the plurality of zones d) obtaining sound reflecting surface information for each identified reflecting surface by determining a material of the sound reflecting surface from the image;

e) outputting a directional sound to each of the identified sound reflecting surfaces according to the obtained sound reflecting surface information.

11. A non-transitory computer readable medium having stored thereon a program for a computer, the program comprising:

by a sound reflecting surface determining section, determining a sound reflecting surface as an object reflecting a sound while the computer is concurrently outputting audio, wherein the sound reflecting surface determining section determines the sound reflecting surface by:

a) obtaining an image of a room captured by a camera;

b) identifying a position of a user in the room using the image;

c) dividing the image into a plurality of zones;

d) identifying the sound reflecting surface in a zone from the plurality of zones; and e) periodically repeating steps a) to d) to determine if the sound reflecting surface has changed or if the position of the user blocks the sound reflecting surface;

by a sound reflecting surface information obtaining section, obtaining sound reflecting surface information indicating a sound reflection characteristic of the determined sound reflecting surface by determining a material of the sound reflecting surface from the image; and by a sound output control portion, outputting a directional sound toward the determined sound reflecting surface according to the obtained sound reflecting surface information.

* * * * *